United States Patent [19]

Barale

[11] Patent Number: 4,463,713

[45] Date of Patent: Aug. 7, 1984

[54] HYDRAULIC TAPPET WITH AUTOMATIC TAKING UP OF THE CLEARANCE FOR ENDOTHERMIC ENGINES

[75] Inventor: Danilo Barale, Turin, Italy

[73] Assignee: RIV-SKF Officine di Villar Perosa S.p.A., Turin, Italy

[21] Appl. No.: 406,857

[22] Filed: Aug. 10, 1982

[30] Foreign Application Priority Data

Sep. 2, 1981 [IT] Italy ..... 53571/81[U]

[51] Int. Cl.[3] ..... F01L 1/24

[52] U.S. Cl. ..... 123/90.55; 123/90.53; 123/90.56

[58] Field of Search ..... 123/90.48, 90.46, 90.52, 123/90.55, 90.56, 90.57

[56] References Cited

U.S. PATENT DOCUMENTS

| | | | |
|---|---|---|---|
| Re. 21,802 | 5/1941 | Russell | 123/90.53 |
| 2,432,762 | 12/1947 | Hoern | 123/90.55 |
| 4,279,226 | 7/1981 | Lampredi et al. | 123/90.48 |

FOREIGN PATENT DOCUMENTS

| | | | |
|---|---|---|---|
| 2011871 | 9/1971 | Fed. Rep. of Germany | 123/90.46 |

*Primary Examiner*—Ira S. Lazarus
*Assistant Examiner*—R. S. Bailey
*Attorney, Agent, or Firm*—Shlesinger Arkwright Garvey & Fado

[57] ABSTRACT

Hydraulic tappet comprising a first and a second body shaped as a socket defining between them a chamber suited to be filled with a fluid coming from a source through an appropriate duct formed in the said socket bodies; along the said duct is arranged a ball for intercepting the fluid under pressure located in a corresponding conical seat formed in the bottom wall of the second socket and forming the outlet of the duct into the said chamber; in the bottom wall is formed an annular groove housing an elastic ring which partially occludes the said conical seat so as to allow a free movement of the ball inside the seat but not the exit of the ball from the seat.

4 Claims, 6 Drawing Figures

HYDRAULIC TAPPET WITH AUTOMATIC TAKING UP OF THE CLEARANCE FOR ENDOTHERMIC ENGINES

BACKGROUND OF THE INVENTION

The present invention relates to a hydraulic tappet with automatic taking up of the clearance for an endothermic engine which is suited to be mounted between a cam fitted on a camshaft and the end of a valve stem of the above-mentioned endothermic engine.

There are today on the market many and different devices which control the clearance in a continuous and automatic manner by hydraulics.

The present invention relates in particular to a hydraulic tappet of the type comprising two bodies having the shape of a socket, the first of which is partly contained in the second and defines with it an interval chamber suited to be filled with a lubricating liquid, in preference oil, coming from a source under pressure through a duct formed in the walls (lateral and bottom) of the two sockets. The tappet further comprises a ball which cooperates with a conical seat formed in the region of the duct leading in the said chamber; the said ball acts as a member for the interception of the liquid along the duct itself.

Indeed, in order to prevent the exit of the ball from the respective seat, in one modification of the prior art the tappet is provided with a member having an annular form comprising a pair of concentric rings connected by radial arms; said member is in particular snap mounted on a tang protruding axially from a bottom wall of the inner socket toward the said chamber and in a way such that the outer ring occludes the movement of the ball into the chamber. In another arrangement, the ball is retained by the use of a radial pin inserted in a respective radial hole of the said tang. Both of these arrangements, besides being economically expensive, turned out in the long run to be of low reliability. Further, each of them require use of a tang or in any case of a portion protruding from the bottom wall of the inner socket, and this is not always attainable because the chamber in which the liquid flows under pressure must sometimes have a very low height.

SUMMARY OF THE INVENTION

An object of the present invention is to realize a hydraulic tappet with automatic take up of the clearance which does not have the drawback inherent to the tappets of the known and above-mentioned type.

The said object is realized according to the present invention in that it relates to a hydraulic tappet with automatic take up of the clearance for an endothermic engine and suited to be mounted between a cam fitted on a camshaft and a stem of a valve of the said engine, the said hydraulic tappet being of the type comprising a first body shaped as a socket suited to be mounted axially movable in a corresponding seat formed in the head of the said engine and having a side wall and a bottom wall cooperating with the said cam; a second body shaped as a socket sliding inside the said first socket body and having a side wall and a bottom wall which defines, together with the bottom wall of the said first body, a chamber and where the opposite end is suited to cooperate with the said valve stem; the walls of the said first and second socket bodies having at least a duct connecting the said chamber with a source of a liquid under pressure; and at least a ball suited to intercept the said liquid and cooperating with a corresponding seat formed in the said bottom wall of the said second body in relation with the region in which the said duct leads in the said chamber; the said tappet being characterized in that in said bottom wall of the second socket body is formed an annular groove traversing the said region in which the said duct leads in the said chamber, the said annular groove being engaged by an annular member elastically yieldable which partly occludes the said seat of the said ball from the side facing the said chamber so as to prevent the said ball from leaving the said seat, while allowing its movement inside the said seat.

BRIEF DESCRIPTION OF THE DRAWINGS

For a better understanding of the present invention it will be now described as a non limiting example, a preferred realization with reference to the accompanying drawings, in which.

DETAILED DESCRIPTION OF THE INVENTION

Figure 1:
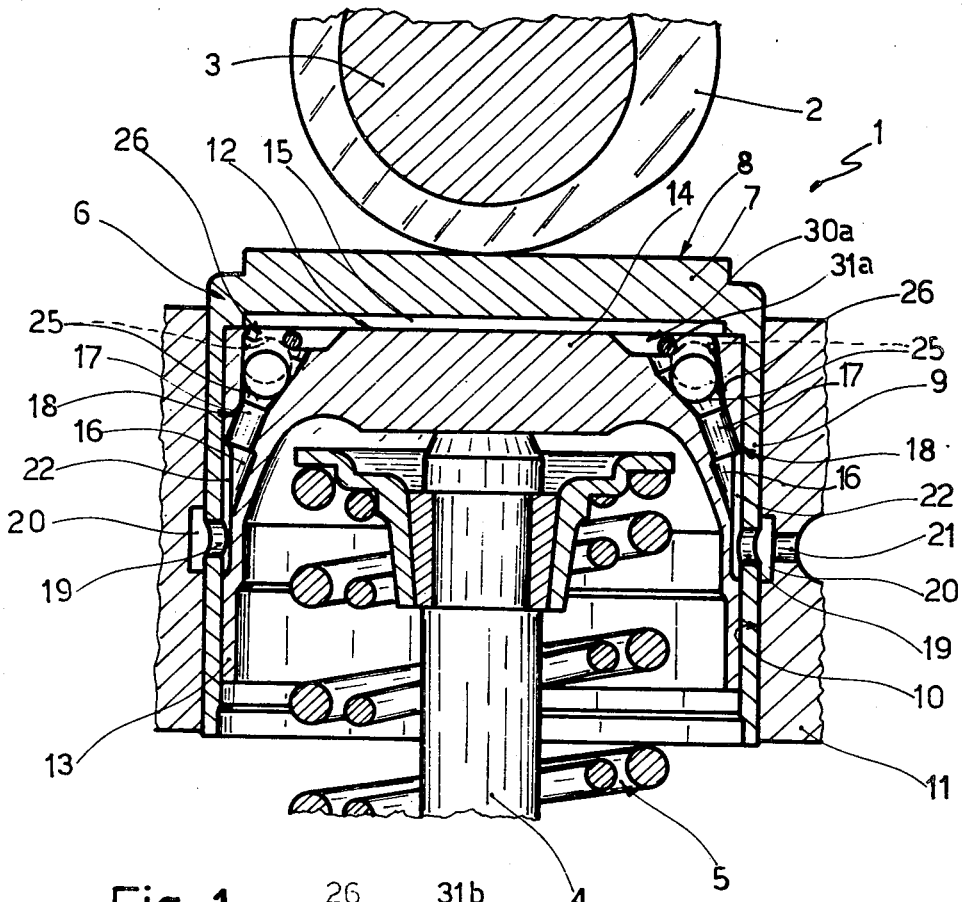
FIG. 1 is a longitudinal cross section of a tappet according to the present invention.

With particular reference to FIG. 1, as indicated in general at 1 a hydraulic tappet with automatic taking up of the clearance for an endothermic engine is shown. The tappet 1 is mounted between a cam 2 of a camshaft 3 and a stem 4 of a valve (not shown) of the above-mentioned engine. In particular, the stem 4 has its end which by means of a known set of springs 5, is maintained in contact with the tappet 1.

The hydraulic tappet 1 comprises substantially a first body 6 shaped as a socket, which has a bottom wall 7 substantially flat, the external surface (8) of which can cooperate with a corresponding surface of the cam 2 conveniently by means of a washer (not shown); the body 6 further has a side wall 9 which is slidable in a corresponding seat 10 formed in a head 11 of the above-mentioned endothermic engine. The tappet 1 further comprises a second body 12 shaped as a socket, sliding inside the first body and having as well a side wall 13 and a bottom wall 14. In particular, the opposing surfaces of the walls 14 and 7 respectively of the bodies 12 and 6 define a chamber 15 which is substantially cylindrical. Furthermore, at the end opposite to the chamber 15, the wall 14 contacts the end of the above-mentioned stem 4 of the valve. The bodies 6 and 12 have a plurality of ducts 18, through which a source of liquid under pressure, as for instance lubricating oil for the engine, is supplied to the interior of the chamber 15. In particular, each duct 18 communicates with a radial hole 19 formed in the wall 9 of the body 2 and includes a pair of inclined passages 16, 17 formed in the body 6. The hole 19 communicates with the said source under pressure through an annular chamber 20 and a hole 21 formed in the head 11, and further communicates with an annular chamber 22 formed on the external surface of the side wall 13 of the second socket body 12. The annular chamber 22, by means of the oblique holes 16 and 17, communicates with the chamber 15: in particular, each passage port of duct 17 into the chamber 15 is controlled by a respective ball 25 which is housed in a corresponding seat 26 in form of a truncated cone, the axis of which conveniently coincides with the axis of the oblique holes 16 and 17.

According to the present invention, the bottom wall 14 of the second socket body 12 presents frontally, on the portion facing the chamber 15, an annular groove 30 with cross section in form of a parallelogram and the diameter of which extends up to touch part of the seat 26 of each ball 25. Inside the groove 30*a* there is mounted an elastic ring 31*a*, the diameter of which, at rest, is slightly larger than the diameter of the groove 30; therefore, the elastic ring 31 in this situation tends to extend and occupies then the groove as illustrated in FIG. 1, and in said region is retained by the fact that the bottom and side walls respectively of the groove form an acute angle.

Figure 2:
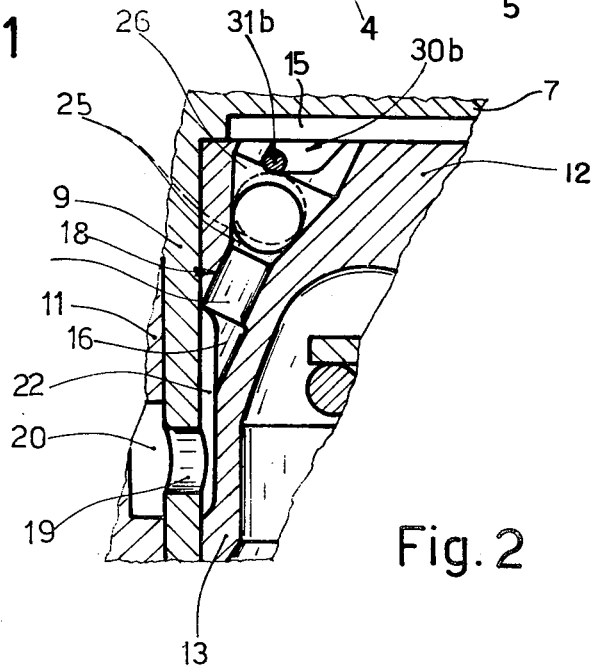
FIGS. 2, 3, 4, 5 and 6 are enlarged cross sections of different modifications of a detail of the tappet of FIG. 1.
Figure 3:
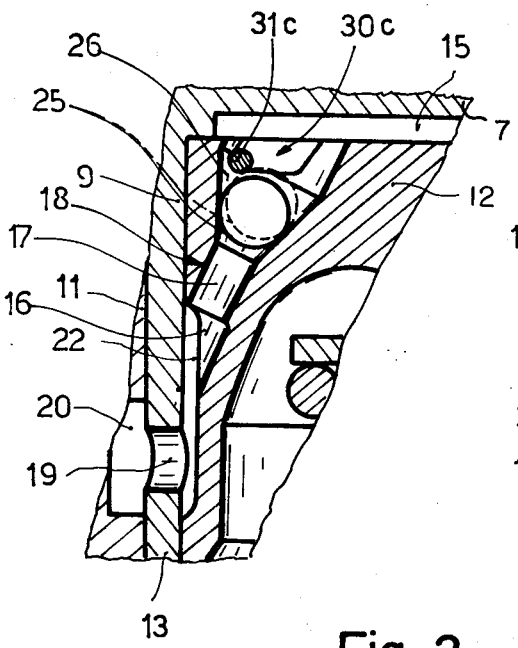

FIGS. 2 and 3 illustrate two modified embodiments of the socket body 12. In particular the diameter of the groove and the elastic ring, respectively, 30*b*, 31*b* in FIG. 2, and 30*c*, 31*c* in FIG. 3 is now enlarged. In each of the FIGS. 1, 2, 3, the position of the elastic ring 31*a, b, c* is such that it prevents the ball 25 from leaving the seat 26 by holding the ball 25 against an obstacle (ring 31*a, b, c*) on the right, on the left or at the center, while permitting, the movement of the ball 25 inside the seat 26 (see the position of the hatched ball 25).

Figure 4:
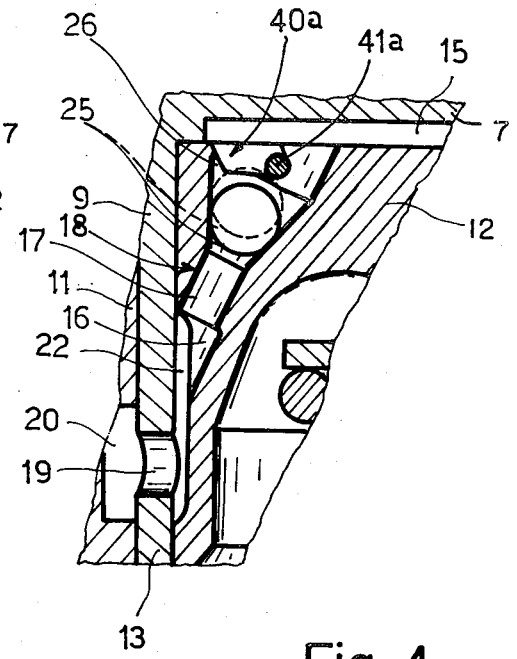
Figure 5:
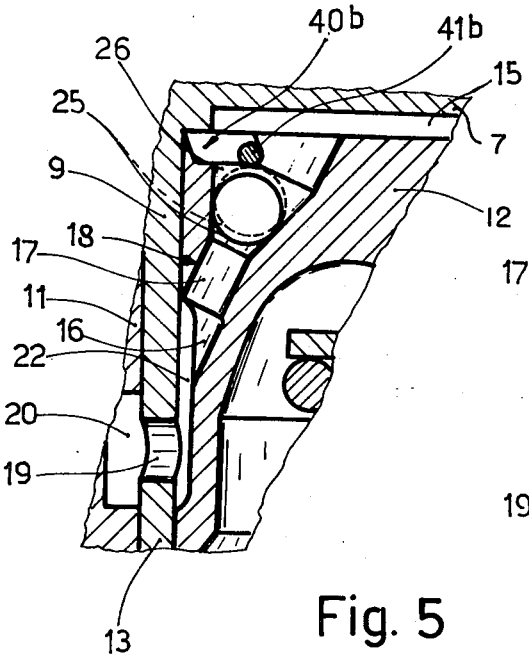
Figure 6:
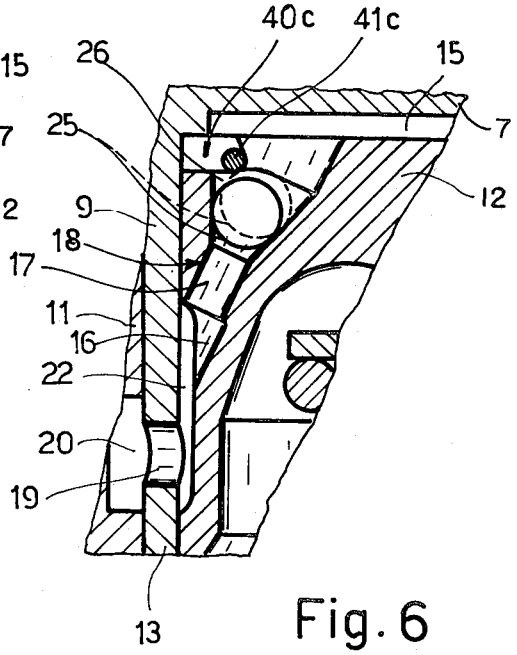

Similarly to what is described above, it can be seen, with reference to FIGS. 4, 5, 6, that the retention of the ball 25 can also be obtained keeping the elastic ring in the same position as the previous FIGS. 1, 2, 3, and forming the annular groove in the bottom wall 14 of the socket body 12 with the oblique sides sloping in the opposite direction to the others. In this case, the elastic ring should be selected with a diameter slightly smaller than the smallest diameter of the respective groove in which it is introduced. In FIGS. 4, 5 and 6, the groove and the corresponding elastic ring are now denoted respectively as 40*a*, 41*a*; 40*b*, 41*b*; and 40*c*, 41*c*.

From an examination of the features of the above-described tappet 1 it is obvious that it allows to attain the predetermined object. Indeed, the holding of the ball 25 inside the respective seat 26 is obtained in a simple and highly reliable way, while allowing the movement of the ball 25 in the seat itself. Furthermore, no restraint is now imposed to the shape of the chamber 15, since the elastic ring 31*a, b, c* or 41*a, b, c* is now completely enclosed in the respective groove 30*a, b, c* or 40*a, b, c*, formed in the bottom wall 14 of the socket body 12.

It is finally obvious that in the hydraulic tappet 1 above-described there can be made wide changes and modifications without departing from the present invention.

I claim:

1. A hydraulic tappet (1) with automatic take-up of the clearance for an endothermic engine and adapted to be mounted between a cam (2) fitted on a camshaft (3) and a stem (4) of a valve of the said engine, the said hydraulic tappet (1) being of the type comprising a first body (6) shaped as a socket suited to be mounted axially movable in a corresponding seat (10) formed on the head (11) of the said engine and having a side wall (9) and a wall (7) which cooperates with the cam (2); a second body (12) shaped as a socket sliding inside said socket body (6) and having a side wall (13) and a wall (14) which defines, together with the wall (7) of the first body (6) a chamber (15) the wall (14) also being in engagement with the stem (4) of the valve; the wall of the second socket body (12) having a plurality of circumferentially positioned ducts (18) connected to a corresponding seat (26) that connects with the chamber (15) with a source of liquid under pressure; and a ball (25) in each seat (26) which is adapted to intercept the liquid and which cooperates with a corresponding seat (26) formed in the wall (14) of the second socket body (12) in relation with the region in which the duct (18) leads into the chamber (15); the tappet (1) being characterized in that in the wall (14) of the second socket body (12) has an annular groove (30*a, b, c*; 40*a, b, c*) adjacent the region in which the seats (26) lead into the chamber (15), and an elastically yieldable annular ring partially seated by snap fit in the annular groove (30*a, b, c*) which partly blocks the upper portion of each of the seats (26) so as to prevent the balls (25) from leaving the seat (26), while allowing its free movement inside the seat (26).

2. A tappet (1) according to claim 1, characterized in that the annular groove (30*a, b, c*; 40*a, b, c*) has a cross section in the form of a parallelogram and the annular member (31*a, b, c*; 41*a, b, c*) is housed in the region of the groove (30*a, b, c*; 40*a, b, c*) the walls of which define an acute angle and develops an elastic thrust practically toward the vertex of the acute angle.

3. A tappet (1) according to claim 2, characterized in that the annular groove (30*a, b, c*) has the acute angle on the side having the smaller diameter, and the annular member (31*a, b, c*) elastically yieldable has, at rest, a diameter conveniently smaller than the smaller diameter.

4. A tappet (1) according to claim 2, characterized in that the annular groove (40*a, b, c*) has the acute angle on the side having the larger diameter, and the annular member (41*a, b, c*) elastically yieldable has, at rest, a diameter conveniently larger than the larger diameter.

* * * * *